US005950847A

United States Patent [19]

Kröll et al.

[11] Patent Number: 5,950,847

[45] Date of Patent: Sep. 14, 1999

[54] RAILBORNE MOBILE CRANE WITH AN AUXILIARY CAR COUPLED TO THE CRANE VEHICLE

[75] Inventors: Joachim Kröll, Jüchen; Peter Richter, Bergheim; Hermann Franzen, Mönchengladbach, all of Germany

[73] Assignee: Mannesmann AG, Düsseldorf, Germany

[21] Appl. No.: 09/084,138

[22] Filed: May 26, 1998

[30] Foreign Application Priority Data

May 26, 1997 [DE] Germany ..... 197 22 884

[51] Int. Cl.[6] ..... B66C 23/36

[52] U.S. Cl. ..... 212/294; 212/299

[58] Field of Search ..... 280/404; 212/180, 212/294, 299, 300, 301

[56] References Cited

U.S. PATENT DOCUMENTS

| | | | |
|---|---|---|---|
| 2,157,376 | 5/1939 | Zeilman | 280/414 |
| 2,649,211 | 8/1953 | Fero | 212/180 |

FOREIGN PATENT DOCUMENTS

| | | | |
|---|---|---|---|
| 356 894 | 6/1961 | Germany . | |
| 12 34 959 | 2/1967 | Germany . | |
| 12 82 271 | 11/1968 | Germany . | |
| 280 519 | 7/1990 | Germany . | |
| 580998 | 11/1977 | U.S.S.R. | 280/404 |
| 232602 | 2/1986 | U.S.S.R. | 212/294 |
| 1703606 | 1/1992 | U.S.S.R. | 212/299 |

*Primary Examiner*—Thomas J. Brahan

*Attorney, Agent, or Firm*—Cohen, Pontani, Lieberman, Pavane

[57] ABSTRACT

A railborne mobile crane with an auxiliary car which is coupled to the crane car and has a supporting device for the head of the boom during transport, wherein the boom lies essentially horizontally and is articulated at the boom base at the pivoting frame of the mobile crane. The boom head which extends the boom in the longitudinal axial direction is connected with the boom so as to be articulated vertically and can be deposited on the supporting device which is fastened to the auxiliary car so as to be pivotable about a horizontal axle and is provided with a three-dimensionally articulated abutment for the boom head which is, in turn, displaceable on the supporting device transverse to the longitudinal axis of the boom.

7 Claims, 6 Drawing Sheets

RAILBORNE MOBILE CRANE WITH AN AUXILIARY CAR COUPLED TO THE CRANE VEHICLE

BACKGROUND OF THE INVENTION

I. Field of the Invention

The invention is directed to a railborne mobile crane with an auxiliary car which is coupled to the crane car and has a supporting device for the head of the boom during transport, wherein the boom lies essentially horizontally and is articulated at the boom base at the pivoting frame of the mobile crane.

II. Description of Related Art

Railborne mobile cranes with transport cars for depositing the boom are generally known. For example, DE-AS 1282271 describes a crane in which, in order to reduce loading of the truck axles, the head of the boom is deposited on a transport car coupled with the mobile crane, so that part of the weight of the boom is received by the transport car.

Another solution for depositing the boom of a mobile crane is described and illustrated in DE-AS 1234959. In this case, reference, in the transport position in which the boom is arranged essentially horizontally, the head of the boom is deposited on a supporting device which is fastened in turn to the transport car, which is called the protection car in the above reference. This reference also addresses the problem that the boom of the mobile crane must be set down so as to be movable because the boom may assume a diagonal position in relation to the auxiliary car when traveling along curves.

While DE-AS 1282271 emphasizes compensation for loading of the axles and suggests that the boom be supported on the chassis of the mobile crane, DE-AS 1234959 described above comes closest to the present invention and forms the prior art on which the present invention improves.

However, the prior art does not take into account the fact that, in addition to the pivoting movements between the mobile crane and the auxiliary car when traveling along curves, still other influences act on the boom which must be taken into account when depositing the boom on a supporting device of the type described. For example, changes in distance between the vehicles occur when they are braked and the bumpers or buffers of the vehicles deflect in a springing manner. The same changes in distance occur as a result of play in the coupling between the mobile crane and auxiliary car or when driving over ramps or acclivities, wherein the mobile crane and the auxiliary car are inclined relative to one another. Superelevation on curves along the stretch of rail must also be compensated for.

In a solution such as that suggested in DE-AS 1234959, all of these influences would have to be absorbed by the supporting device or by the pivot bearing of the release at the pivot frame of the mobile crane. Means and steps for preventing or compensating for this are not provided. This known construction only takes into consideration movements from curve travel into a horizontal plane in that the push rods for the movement of the swivelable roof of the crane protected therein are designed so as to be longitudinally displaceable. However, this is not sufficient for the movements and changes in movement which actually occur.

SUMMARY OF THE INVENTION

It is the object of the present invention to improve the existing mobile crane in such a way that relative movements between the mobile crane and the auxiliary car due to coupling play, buffer play, springing deflection of buffers, travel over acclivities, along curves and curve superelevations are compensated for without the occurrence of compulsory or constraining forces at the crane boom, at the crane pivot mechanism or at the auxiliary car.

In order to meet this object, the boom, head which is attached to the boom in the longitudinal direction, is connected with the boom so as to be articulated vertically and can be deposited on the supporting device which is fastened to the auxiliary car so as to be pivotable about a horizontal pivoting axis in the direction of the boom and is provided with a three-dimensionally articulated abutment for the boom head which is, in turn, displaceable on the supporting device transverse to the longitudinal axis of the boom.

An economical and easily manageable boom support with all necessary degrees of freedom is provided by the construction according to the invention. The vertically articulated arrangement of the boom head to which crane hooks and/or pulleys are fastened protects the luffing cylinder of the telescope boom from forces acting in the vertical plane. The free end of the boom head is deposited on the supporting device in an articulated manner; displacements of the boom tip or boom head in the lateral direction are made possible by the displacement capability of the abutment on the supporting device transverse to the longitudinal axis of the boom without constraining forces acting on the auxiliary car. Accordingly, the relatively large lateral offset of the boom which occurs when traversing small curve radii or turning radii between the boom and supporting device is compensated for.

In another embodiment of the invention the connection of the boom head with the boom is carried out by means of a horizontal swiveling axle extending transverse to the longitudinal axis of the boom at the upper flange of the boom and via a contact joint at the lower flange. The horizontal swiveling axle is formed by pins, the contact joint at the lower flange limits the swiveling path of the boom head downward when the boom is raised into its working position.

According to a further embodiment of the invention, the abutment for the boom head is preferably arranged on a support carriage which is freely movable transverse to the longitudinal axis of the auxiliary car on rails with low friction on the side of the supporting device remote of the pivot bearing. For this purpose, the support carriage advantageously has wheels which are movable on both sides of the support carriage in rails so as to enable the low-friction displacement of the abutment.

In an additional embodiment of the invention, the abutment is constricted as a spherical cap forming a ball-and-socket joint connection with a ball which is fastened to the boom head. In this way, changes in length of the above-mentioned type between the boom head and the supporting device can be absorbed in all directions without constraining forces being conducted into parts of the vehicle.

According to a further embodiment of the invention, in order to prevent the boom head from swiveling up out of the abutment, locks are provided at the supporting device which can be placed around the upper half of the ball and by which the ball can be secured vertically in the cap. These locks are preferably constructed in two parts and are pushed over the ball in a scissor-like manner.

According to still another embodiment, the supporting device is pivotable about its horizontal axis into a horizontal rest position on the auxiliary car. This pivoting is important when loads, e.g., the lateral supports and/or counterweights of the mobile crane, are to be transported on the auxiliary car in addition to the support of the boom head, because, in this case, the boom must be capable of telescoping in the direction of the auxiliary car in order to receive these loads. The loads to be received must be able to be picked up and transported in the eventuality of limited upper working height without this process being hindered by the supporting device.

In order to facilitate moving the supporting device out of the rest position into the support position, at least one energy accumulator is articulated between the auxiliary car and the supporting device in such a way that the force which is stored in the energy accumulator and which essentially corresponds to the inherent or dead weight of the supporting device assists in the movement of the supporting device out of the horizontal rest position into the upright position and the supporting device in the unloaded state is moved against a stop which limits its pivoting movement. The energy accumulators can be tension springs, for example, which are attached on one side to the supporting device and, on the other side, to the retaining arm of a bearing block at which the horizontal swiveling axle for the supporting device is provided and which produces the connection with the auxiliary car.

The invention provides a simple and dependably operating solution to the problems described above; all relative movements between the mobile crane and auxiliary car due to coupling play, buffer play, springing deflection of buffers, traveling over acclivities, traveling over curves and curve superelevations are compensated for without loading the crane boom or crane pivoting mechanism.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE INVENTION

Figure 1:
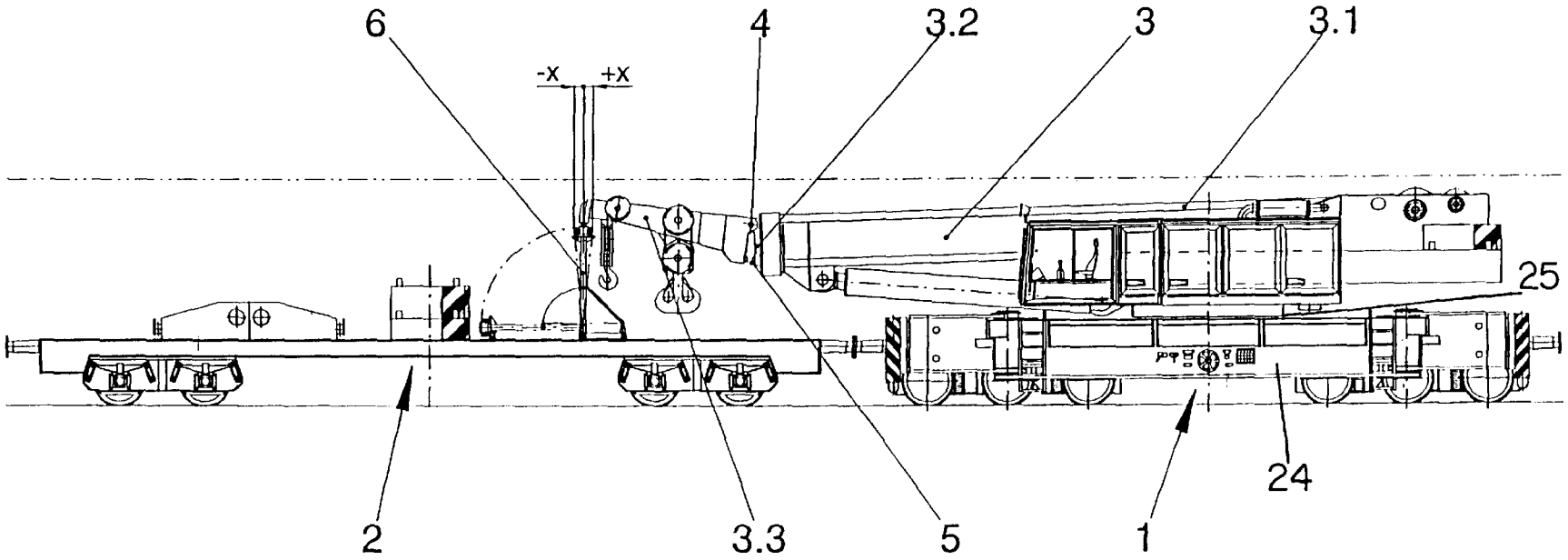
FIG. 1 shows a side view of a mobile crane vehicle according to the invention.

FIG. 1 shows the side view of a railborne mobile crane vehicle including a railborne mobile crane 1 coupled with an auxiliary car 2 in the transport position. The crane boom 3 comprises the boom base 3.1, at least one telescope boom part 3.2, and the vertically swivelable boom head 3.3 which is supported at the upper flange in a pin joint 4 and at the lower flange via a contact joint 5. The boom 3 is pivotally connected with a crane car 24 through a pivoting frame 25. In the transport position, the boom head according to the invention is supported on the pin joint 4 and a supporting device 6 mounted on the auxiliary car 2.

Figure 2:
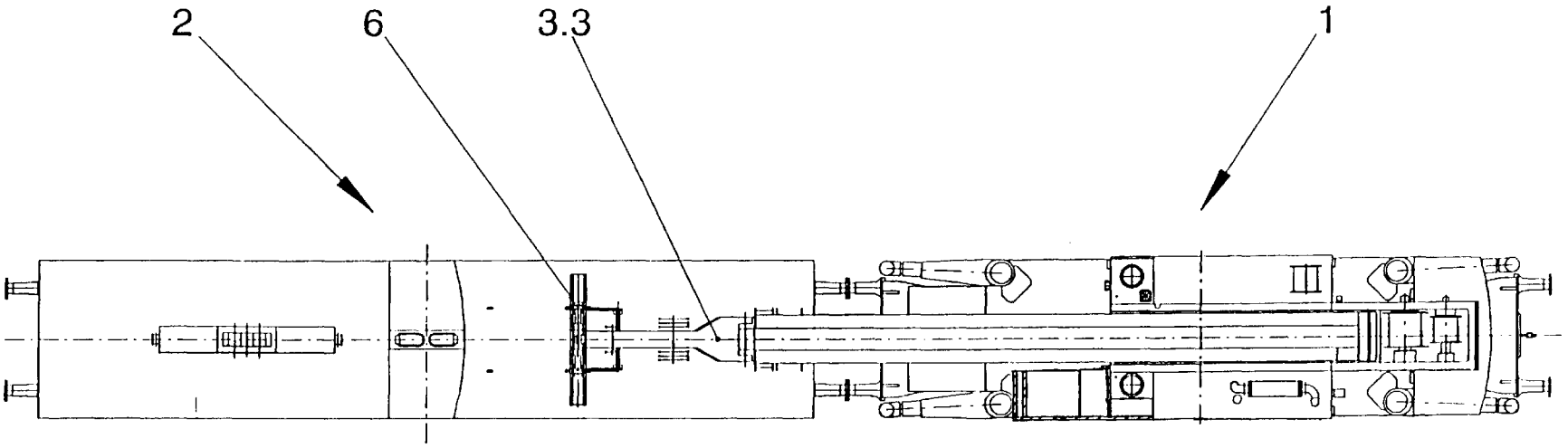
FIG. 2 shows a top view of the mobile crane vehicle according to FIG. 1.

As can be seen in FIG. 2, which shows a top view of the railborne mobile crane 1 coupled with the auxiliary car 2 in the transport position when traveling along a straight path, the boom head 3.3 lies approximately in the longitudinal axis of the crane 1 and the auxiliary car 2 and is supported centrally on the supporting device 6.

Figure 3:
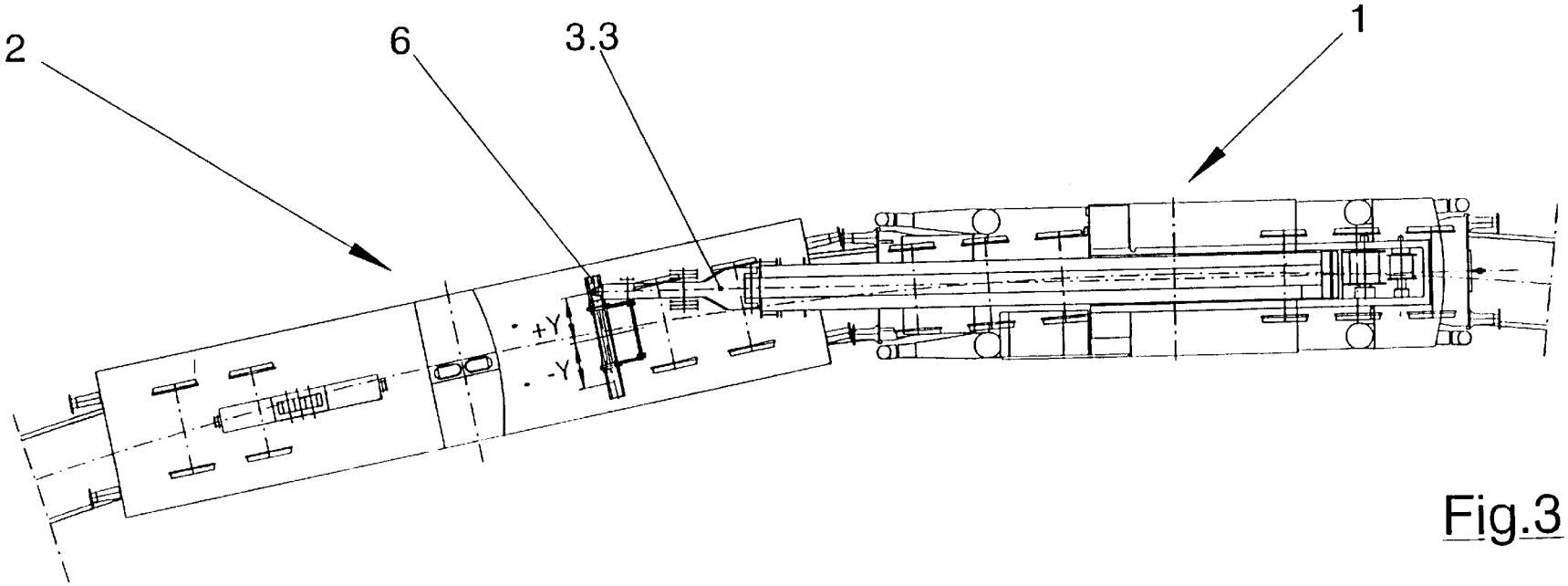
FIG. 3 shows a top view of the mobile crane vehicle according to FIG. 1 when traveling over curves.

FIG. 3 shows the mobile crane and the auxiliary car in the position which results when the vehicle travels along a curve. The figure shows the smallest permissible curve radius or turning radius for which the supporting device is designed. As can be seen, the boom head 3.3 is supported off-center on the supporting device 6 in this position, the supporting device 6 being constructed in a special manner for this purpose as is shown in FIG. 4.

Figure 4:
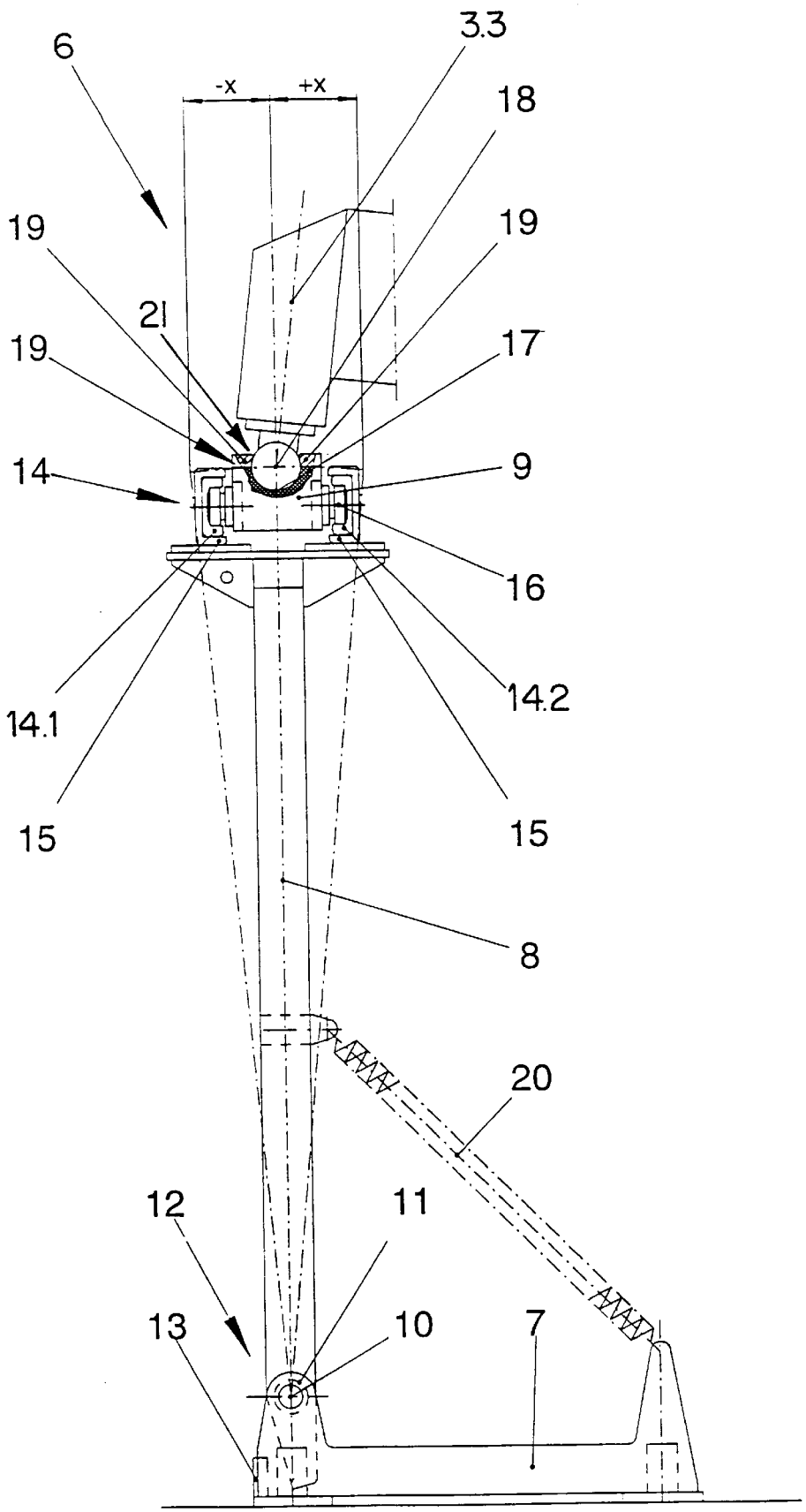
FIG. 4 is a side view showing the supporting device according to the invention.

It can be seen from the side view in FIG. 4 that the supporting device 6 is mounted at the bearing block 7 fastened to the auxiliary car 2 and carries a supporting carriage 9 on the deposit support 8. The supporting device 6 swivels with the deposit support 8 around the horizontal axle 10, wherein the bearing bushes 11 guarantee a small sliding friction coefficient. Below the pivot bearing 12 formed by the axle 10 and the bearing bushes 11, a stop 13 limits the swiveling area of the supporting device 6 in the direction opposite to the deposit direction of the supporting device 6.

On the side of the supporting device 6 opposite the pivot bearing 12, a horizontal rolling path 14 which extends transverse to the longitudinal axis of the auxiliary car 2 and is formed of two guide rails 14.1, 14.2 mounted in clamping flanges 15, is provided at the deposit support 8. Four combination rollers 16 which guide the support carriage 9 radially and axially enable a low-friction lateral offset of the support carriage 9 on the rolling path 14. In the center of the support carriage 9, a spherical cap 17, preferably made of plastic, serves as a support bearing for a ball 18 which is preferably made of steel and is fastened to the boom head 3.3. A two-part lock 19 secures the connection at the top in that the locking parts fit in a scissor-like manner around and over the ball 18. Since the ball 18 is pivotal within the spherical cap 17 and the two-part lock 19 about all three coordinate axes, the ball 18, spherical cap 17 and the two-part lock 19 are part of a three-dimensionally articulated abutment 21.

Two tension springs 20 are tensioned between the bearing block 7 and the deposit support 8 of the supporting device 6. The springs 20 partially compensate for the dead weight of the supporting device 6 and facilitate manual erection and folding.

The relative movements between the mobile crane 1 and the auxiliary car 2 due to coupling play, buffer play, springing deflection of buffers, traveling on acclivities, along curves and curve superelevations are compensated for in the range of ±X.

Figure 5:
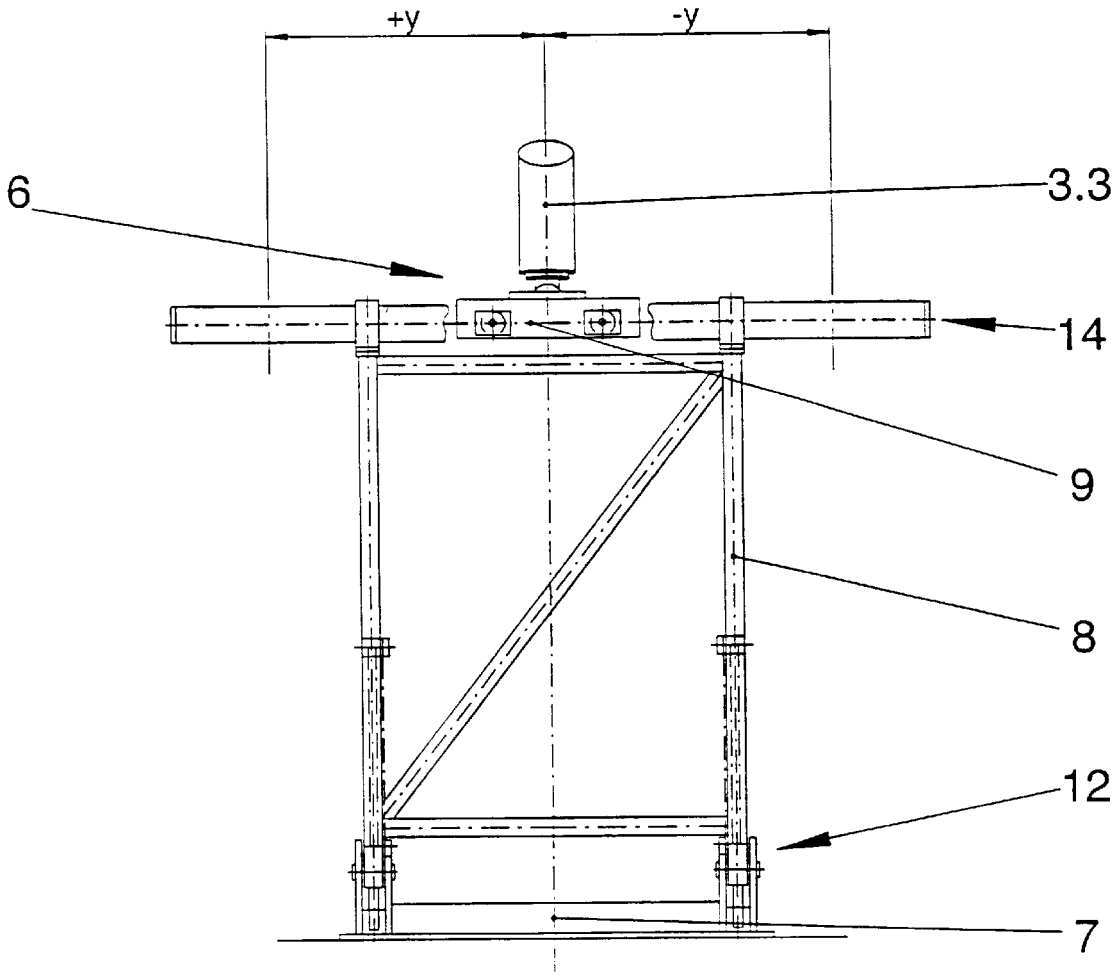
FIG. 5 is a front view of the supporting device according to the invention.

As can be seen from FIG. 5 in a view of the supporting device 6 that is rotated by 90°, the relative movement between the mobile crane 1 and the auxiliary car 2 due to the movements in the range of ±Y acting in the other axial direction are compensated for. This area corresponds to the traveling path of the support carriage 9 on the rolling path 14 whose length is adapted in such a way that the smallest permissible turning radius can also be compensated for.

Figure 6:
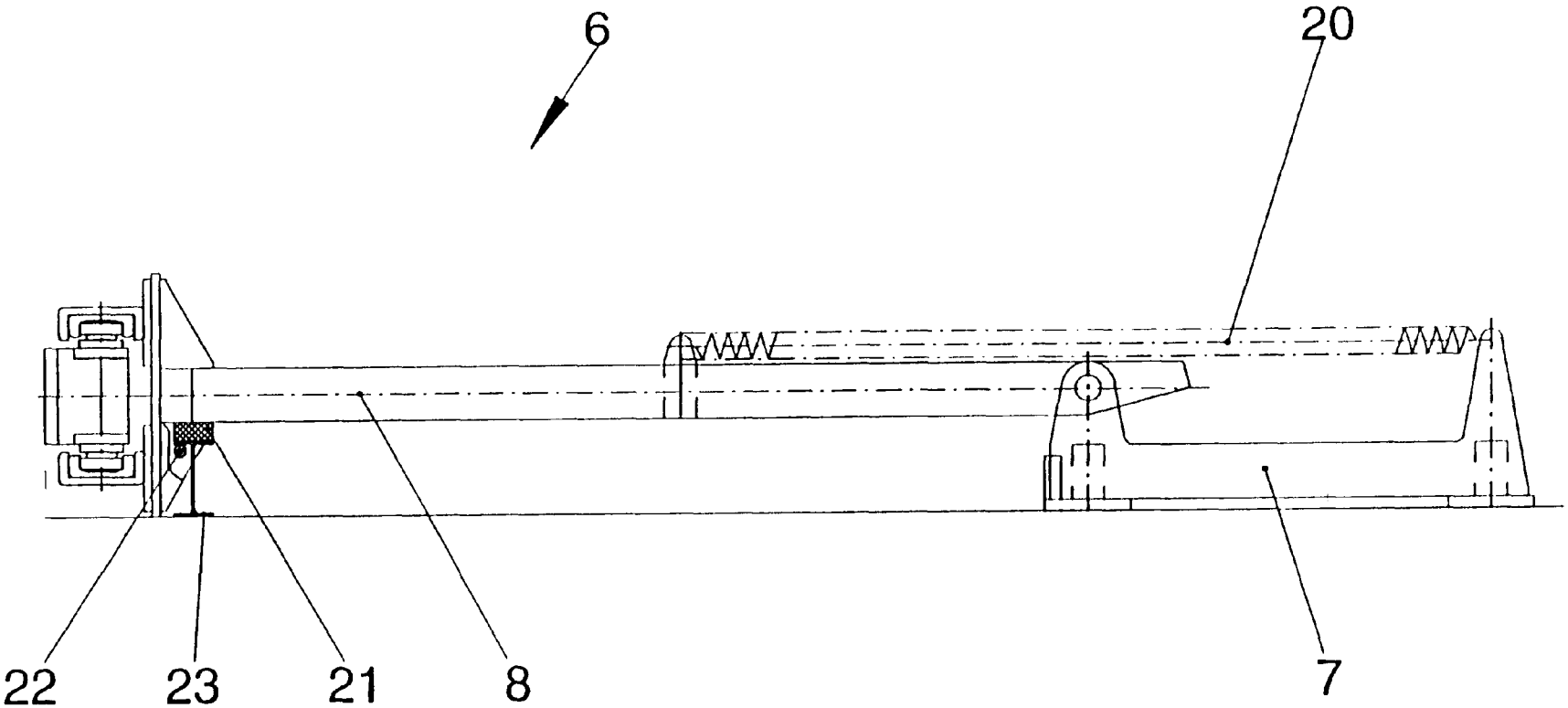
FIG. 6 shows the supporting device according to the invention in the deposited state.

FIG. 6 shows a side view of the supporting device 6 which is deposited on the auxiliary car 2. The deposit support 8 is mounted to an elastic mount 21 and is secured by a pawl 22 to a bearing block 23 as can also be seen in the position shown in dash-dot lines in FIG. 1. The springs 20 are extended and store the necessary force by which the erecting movement of the supporting device 6 is reinforced.

The invention is not limited by the embodiments described above which are presented as examples only but can be modified in various ways within the scope of protection defined by the appended patent claims.

We claim:

1. A railborne mobile crane vehicle, comprising:

a railborne mobile crane which includes a boom, a crane car, and a pivoting frame for pivotally connecting said boom with said crane car, said boom comprising a boom base connected to said pivoting frame, a boom part extending longitudinally from said boom base, and a vertically swivelable boom head extending longitudinally from said boom part, said boom being articulated at said boom base at said pivoting frame so as to be movable into a substantially horizontal position;

an auxiliary car coupled to said crane vehicle;

a supporting device fastened to said auxiliary car so as to be pivotable about a horizontal axle, said supporting device including a three-dimensionally articulated abutment for receiving said boom head, said abutment being displaceable on said supporting device transverse to a longitudinal axis of said boom; and means for pivotally connecting said boom head with said boom part so that said boom head is vertically swivelable, said supporting device being operatively arranged for supportably receiving said boom head when said boom is in said substantially horizontal position such that said boom head is supported by said supporting device and said means for pivotally connecting said boom head with said boom part.

2. The railborne mobile crane vehicle in claim 1, wherein said means for pivotally connecting said boom head with said boom part includes an upper flange at said boom part having a horizontal swiveling axis extending transverse to the longitudinal axis of said boom and wherein said boom part further comprises a lower flange having a contact joint, said boom head being pivotally connected to said upper flange and and supportable on said contact joint.

3. The railborne mobile crane vehicle in claim 1, wherein said supporting device further includes a rail at a free end of said supporting device remote to said horizontal axle, and a supporting carriage which is freely movable along said rail and carries said abutment.

4. The railborne mobile crane vehicle in claim 1, wherein said abutment of said supporting device includes a spherical cap and a ball rotatably sitting in said spherical cap so as to form a ball-socket joint connection, said ball being fastened to said boom head.

5. The railborne mobile crane vehicle in claim 4, wherein said abutment of said supporting device further includes lock means placed around an upper half of said ball for securing said ball in said spherical cap.

6. The railborne mobile crane vehicle in claim 1, wherein said supporting device is pivotable about said horizontal axle into a horizontal rest position on said auxiliary car.

7. The railborne mobile crane vehicle in claim 6, and further comprising a stop on said auxiliary car below said horizontal axle for limiting pivoting movement of said supporting device, and an energy accumulator articulated between said auxiliary car and said supporting device for assisting in an erecting movement of said supporting device out of said horizontal rest position by a force corresponding to a dead weight of said supporting device and stored in said energy accumulator.

* * * * *